US012766398B2

(12) United States Patent
Strom

(10) Patent No.: US 12,766,398 B2
(45) Date of Patent: Oct. 20, 2026

(54) AQUATIC BACKSTOP FOR A SKIPPING BALL

(71) Applicant: Corbin Strom, Mechanicville, NY (US)

(72) Inventor: Corbin Strom, Mechanicville, NY (US)

( * ) Notice: Subject to any disclaimer, the term of this patent is extended or adjusted under 35 U.S.C. 154(b) by 363 days.

(21) Appl. No.: 18/418,892

(22) Filed: Jan. 22, 2024

(65) Prior Publication Data

US 2024/0278104 A1 Aug. 22, 2024

Related U.S. Application Data

(60) Provisional application No. 63/485,291, filed on Feb. 16, 2023.

(51) Int. Cl.
*A63B 71/02* (2006.01)
*A63B 67/00* (2006.01)

(52) U.S. Cl.
CPC ..... *A63B 71/022* (2013.01); *A63B 67/002* (2013.01); *A63B 2225/60* (2013.01)

(58) Field of Classification Search
CPC ..... A63B 2225/60; A63B 67/007; A63B 2225/05
See application file for complete search history.

(56) References Cited

U.S. PATENT DOCUMENTS 1,113,264 A * 10/1914 Vanderslice ..... F16M 11/20 248/170
3,172,585 A * 3/1965 Mahaney ..... A63B 55/10 294/166
4,220,337 A 9/1980 Moore
4,786,053 A 11/1988 Barnes, Jr.
7,037,220 B1 5/2006 Gordon
7,229,059 B1 * 6/2007 Hood ..... F16M 13/022 248/205.8

(Continued)

FOREIGN PATENT DOCUMENTS

CN 203458773 U 3/2014
CN 111957021 A 11/2020

(Continued)

OTHER PUBLICATIONS

Anti Wave Global Pty Ltd, Water polo backstop (Year: 2024).*

(Continued)

*Primary Examiner* — Nicholas J. Weiss
(74) *Attorney, Agent, or Firm* — HESLIN ROTHENBERG FARLEY & MESITI P.C.

(57) ABSTRACT

An aquatic backstop includes a lower frame structure including at least three lower corner junctions. The lower frame structure configured to be leveled with a surface of a body of water. An upper frame structure includes hollow corner support posts. Each corner support post extends upwards from each lower corner junction. Netting is disposed on the upper frame structure. Legs are slidably disposed within each of the corner support posts. Each leg is configured to extend downward from each lower corner junction to compensate for a topography of an underlying bottom of the body of water. An anchoring system includes a harness attached to each lower corner junction. An anchoring device is configured to attach to the underlying bottom. Each harness is attachable to the anchoring device to secure the backstop to the underlying bottom.

7 Claims, 6 Drawing Sheets

(56) References Cited

U.S. PATENT DOCUMENTS

| | | | | |
|---|---|---|---|---|
| 10,286,273 | B1 * | 5/2019 | Chouinard | A63B 71/028 |
| 11,724,145 | B1 * | 8/2023 | Stamper | A63B 71/022 482/29 |
| 2001/0009874 | A1 | 7/2001 | Beazley | |
| 2003/0148825 | A1 | 8/2003 | Go | |
| 2010/0009782 | A1 | 1/2010 | Smith | |
| 2019/0134476 | A1 | 5/2019 | Spady | |
| 2019/0338549 | A1 * | 11/2019 | McDermott | E02D 5/801 |
| 2021/0311377 | A1 * | 10/2021 | Salomon, Jr. | F16M 11/34 |
| 2021/0322841 | A1 | 10/2021 | Lodge | |
| 2022/0088452 | A1 | 3/2022 | Wu | |
| 2025/0128133 | A1 * | 4/2025 | Deitz | A63B 69/0002 |

FOREIGN PATENT DOCUMENTS

| | | | |
|---|---|---|---|
| CN | 212383178 | U | 1/2021 |
| JP | 2008012104 | A | 1/2008 |
| RU | 81439 | U1 | 3/2009 |

OTHER PUBLICATIONS

"Anti wave global advises of innovation and export success", SWIM SWAM, Mar. 16, 2022; retrieved on Jan. 22, 2024 from Internet URL: <https://swimswam.com/anti-wave-global-advises-of-innovation-and-export-success/>, 12 pgs.

"Basketball Back-Up Netting", Keeper Goals, retrieved on Jan. 22, 2024 from Internet URL: <https://www.keepergoals.com/portfolio/basketball-back-up-netting/>, 3 pgs.

* cited by examiner

AQUATIC BACKSTOP FOR A SKIPPING BALL

CROSS REFERENCE TO RELATED APPLICATIONS

This application is a non-provisional application of, and claims the benefit of the filing date of, U.S. provisional application 63/485,291, filed Feb. 16, 2023, entitled: "AQUATIC BACKSTOP FOR SKIPPING BALL," the contents of which are incorporated herein by reference.

TECHNICAL FIELD

The present disclosure relates to backstops. More specifically, the disclosure relates to an aquatic backstop for a skipping ball.

BACKGROUND

Water skipping balls are well known and sold a recreational articles that are often made of soft foam and used to skip over water when thrown. However, once thrown, they are often hard to retrieve if they are not caught by hand. This is due to the difficulties of navigating through water to retrieve the skipping balls.

Accordingly, there is a need for a device that can provide a catch for water skipping balls that are not caught by hand once thrown.

BRIEF DESCRIPTION

The present disclosure offers advantages and alternatives over the prior art by providing an aquatic backstop that can provide a catch the water skipping balls if not caught by hand. Additionally, the backstop can be the center piece of various games that may be created. The aquatic backstop is capable of being secured to the underlying bottom of a body of water, whether that bottom is composed of soil in a natural lake or cement in a man-made pool. Additionally, the backstop can compensate for a varying topography of the underlying bottom. Also, the backstop may be capable of pivoting from a fully open extended position for gaming to a collapsed folded position for ease of transporting.

An aquatic backstop in accordance with one or more aspects of the present disclosure includes a lower frame structure including at least three lower corner junctions. The lower frame structure is configured to be leveled with a surface of a body of water. An upper frame structure includes hollow corner support posts. Each corner support post extends upwards above the water from each lower corner junction. Netting is disposable on the upper frame structure. The netting is configured to catch a ball skipping over the water. Legs are slidably disposed within each of the corner support posts. Each leg is configured to extend downward from each lower corner junction to compensate for a topography of an underlying bottom of the body of water. An anchoring system includes a harness attached to each lower corner junction. An anchoring device is configured to attach to the underlying bottom. Each harness is attachable to the anchoring device to secure the backstop to the underlying bottom.

A foldable aquatic backstop in accordance with one or more aspects of the present invention includes a lower frame structure. The lower frame structure includes at least three lower corner junctions. The lower frame structure is configured to be leveled with a surface of a body of water. An upper frame structure includes hollow corner support posts. Each corner support post extends upwards above the water from each lower corner junction. Upper corner junctions are disposed on an upper distal end portion of each corner support post. A central shaft is located between the corner support posts. A lower center junction is slidably disposed on the central shaft. Lower ribs are pivotally attached to both a lower corner junction and the lower center junction. An upper center junction is slidably disposed on the central shaft. Upper ribs are pivotally attached to both an upper corner junction and the upper center junction. Legs are slidably disposed within each of the corner support posts. Each leg is configured to extend downward from each lower corner junction to compensate for a topography of an underlying bottom of the body of water. An anchoring system includes a harness attached to each lower corner junction. An anchoring device is configured to attach to the underlying bottom. Each harness is attachable to the anchoring device to secure the backstop to the underlying bottom.

It should be appreciated that all combinations of the foregoing concepts and additional concepts discussed in greater detail below (provided such concepts are not mutually inconsistent) are contemplated as being part of the inventive subject matter disclosed herein and may be used to achieve the benefits and advantages described herein.

DRAWINGS

The disclosure will be more fully understood from the following detailed description taken in conjunction with the accompanying drawings, in which.

DETAILED DESCRIPTION

Certain examples will now be described to provide an overall understanding of the principles of the structure, function, manufacture, and use of the methods, systems, and devices disclosed herein. One or more examples are illustrated in the accompanying drawings. Those skilled in the art will understand that the methods, systems, and devices specifically described herein and illustrated in the accompanying drawings are non-limiting examples and that the scope of the present disclosure is defined solely by the claims. The features illustrated or described in connection with one example may be combined with the features of other examples. Such modifications and variations are intended to be included within the scope of the present disclosure.

The terms "significantly", "substantially", "approximately", "about", "relatively," or other such similar terms that may be used throughout this disclosure, including the claims, are used to describe and account for small fluctuations, such as due to variations in processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Figure 1:
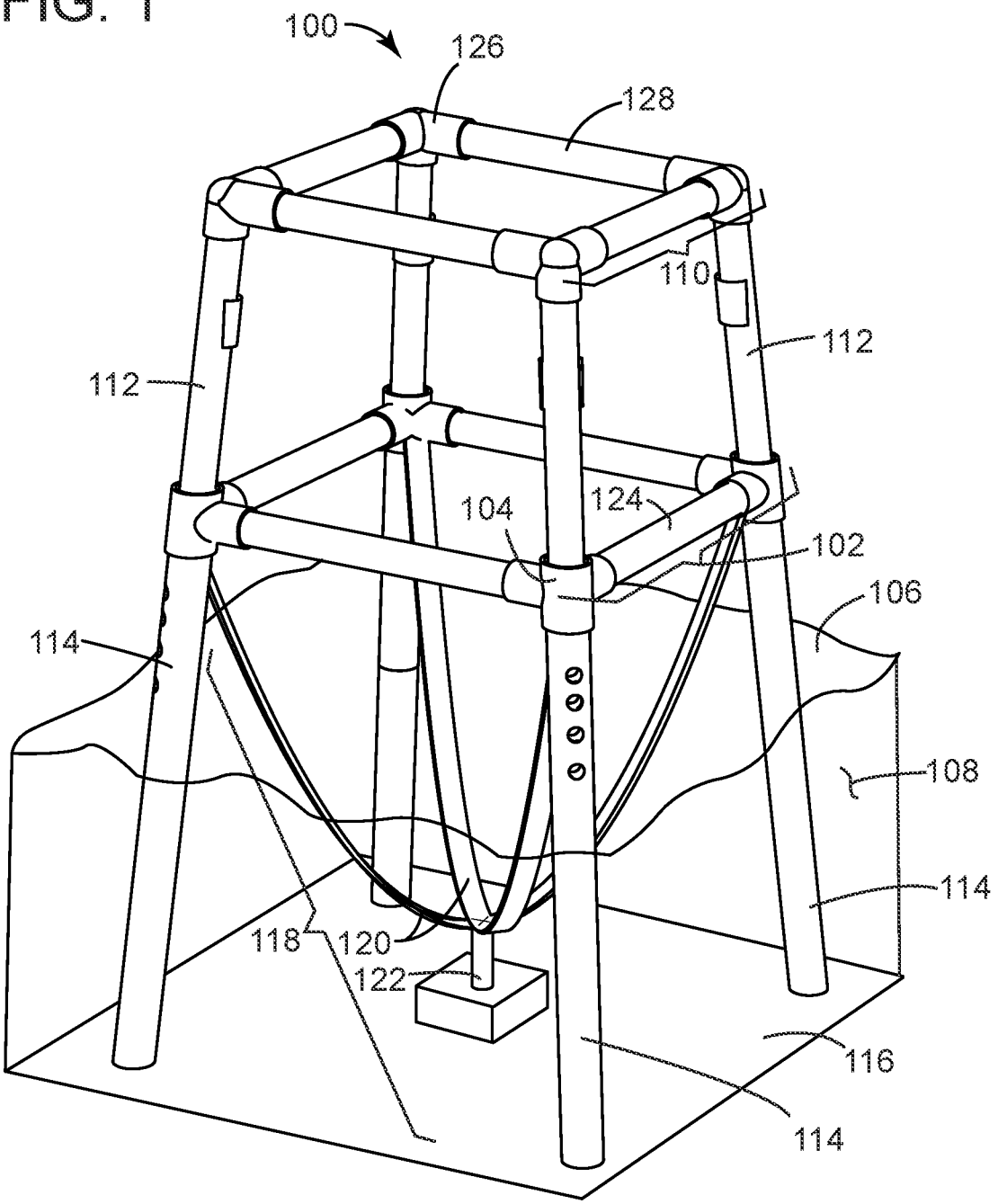
FIG. 1 depicts an example of a perspective view of an aquatic backstop, according to aspects described herein.

Referring to FIG. 1, an example is depicted of a perspective view of an aquatic backstop 100, according to aspects described herein. The backstop 100 includes a lower frame structure 102 that includes at least three lower corner junctions 104. In the example illustrated in FIG. 1, there are four lower corner junctions 104. However, it is within the scope of this disclosure to have 3, 4, 5, 6 or more such lower corner junctions 104. The lower frame structure 102 is configured to be leveled with a surface 106 of a body of water 108.

In the example illustrated in FIG. 1, the backstop is rigid. However, as will be explained in more detail herein, it is within the scope of this disclosure that the backstop may also be foldable.

An upper frame structure 110 of the backstop 100 includes a plurality of hollow corner support posts 112. Each corner support post 112 extends upwards above the surface 106 of the water 108 from each lower corner junction 104.

The upper frame 110 may also have a netting 130 (see FIG. 4) disposed on the upper frame structure 110. The netting 130 may be configured to catch a ball skipping over the water. The netting or upper frame may also include various accessories, such as pockets, hoops, score keeping devices or the like for playing different types of games.

The backstop 100 also includes legs 114 that are slidably disposed within each of the corner support posts 112. Each leg 114 is configured to extend downward from each lower corner junction 104 to compensate for a topography of an underlying bottom 116 of the body of water 108.

In the example of an aquatic backstop 100 illustrated in FIG. 1, the backstop is rigid. Accordingly, the lower frame structure 102 further includes lower horizontal supports 124 that are rigidly attached to and extending substantially horizontally between each lower corner junction 104. Additionally, the upper frame structure 110 further includes a plurality of upper corner junctions 126. Each upper corner junction is disposed on an upper distal end portion of each corner support post 112. The upper frame structure 110 also includes a plurality of upper horizontal supports 128 that are rigidly attached to, and extend substantially horizontally between, each upper corner junction 126.

The backstop 100 also includes an anchoring system 118. The anchoring system includes a harness 120 attached to each lower corner junction 104 and an anchoring device 122 configured to attach to the underlying bottom 116. Each harness 120 is attachable to the anchoring device 122 to secure the backstop 100 to the underlying bottom 116.

Figure 2A:
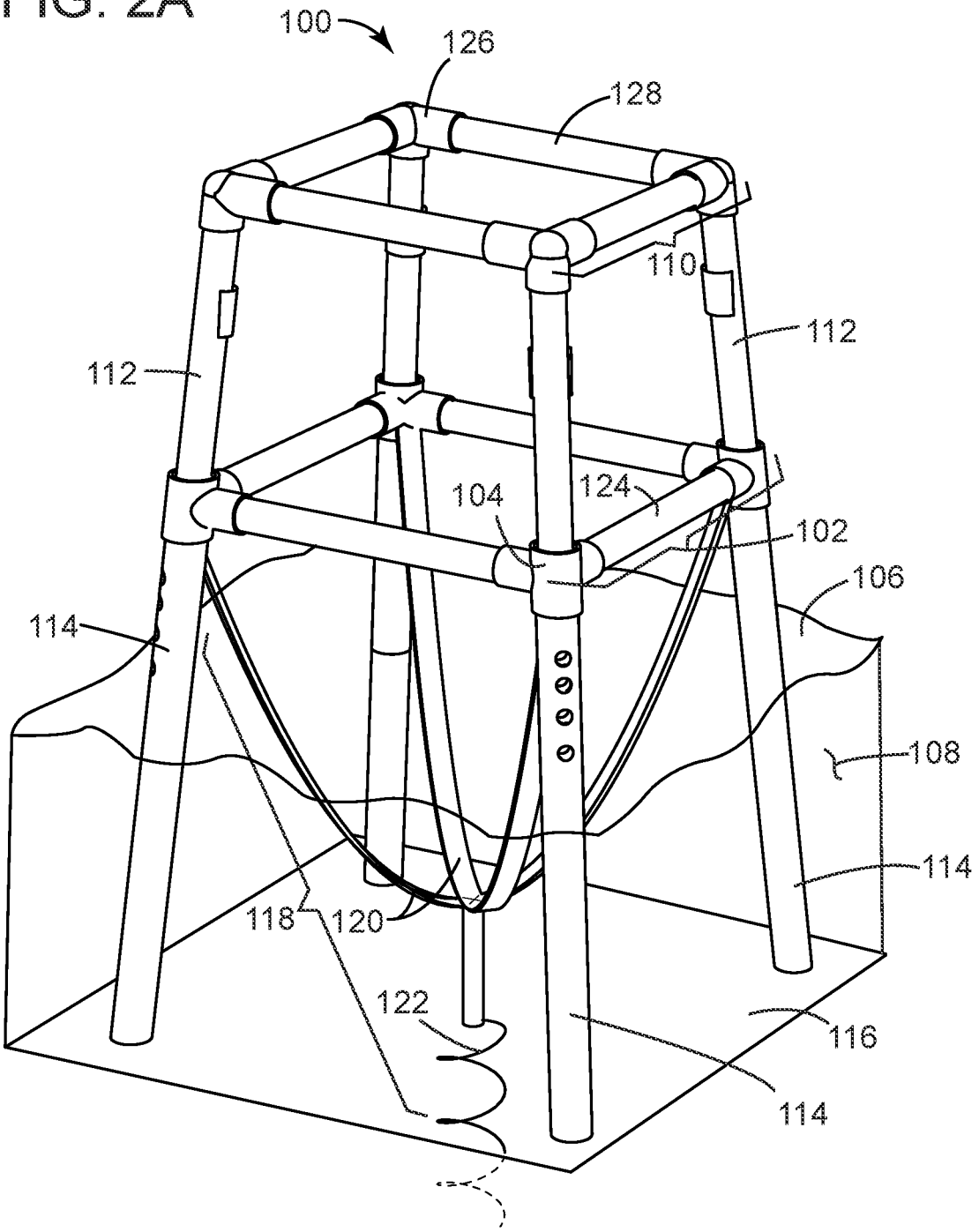
FIG. 2A depicts an example of a perspective view of an anchoring system of the backstop of FIG. 1, wherein an anchoring device of the anchoring system includes a screw that has a corkscrew shape for screwing into soil.
Figure 2B:
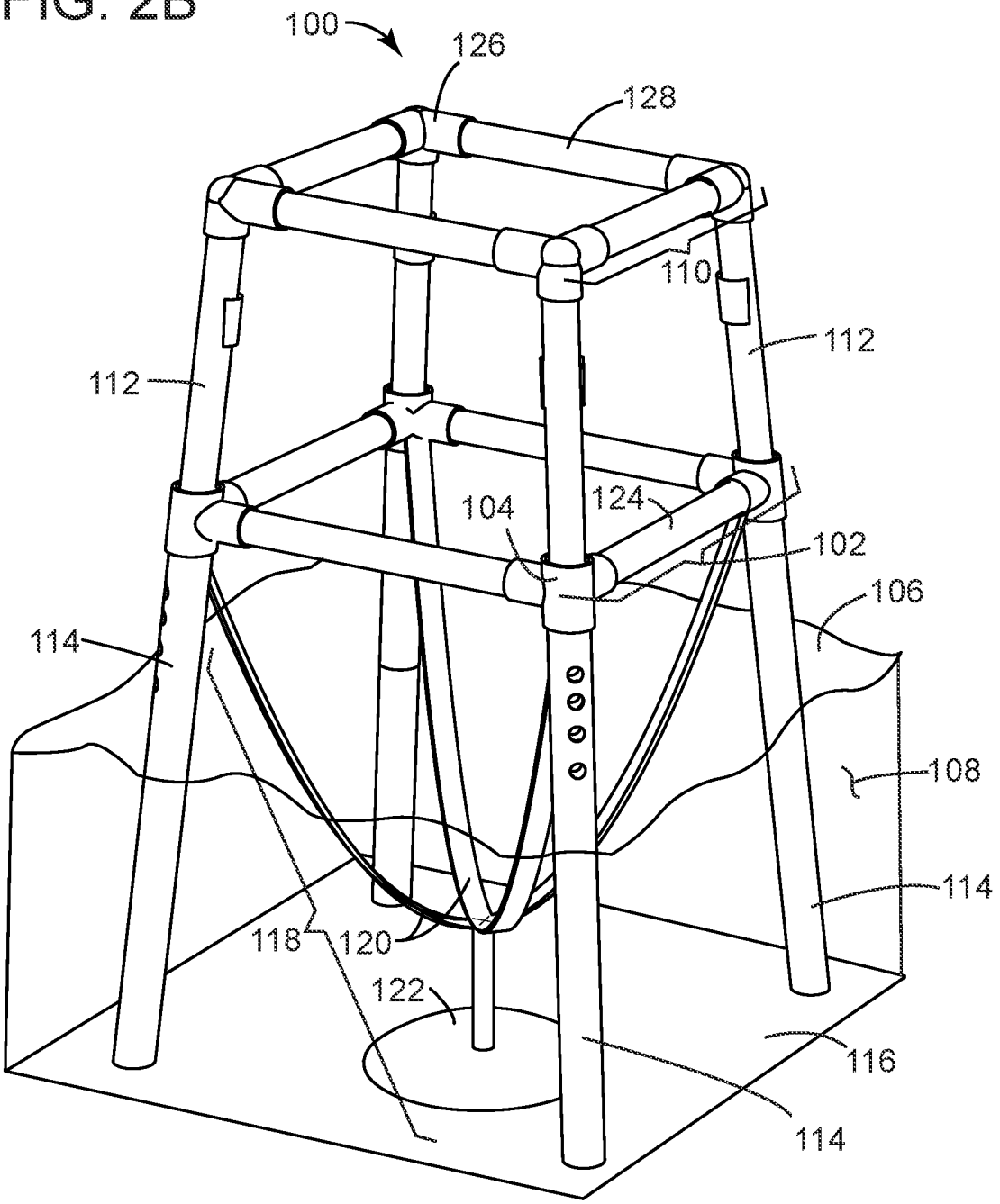
FIG. 2B depicts an example of a perspective view of the anchoring system of the backstop of FIG. 1, wherein the anchoring device of the anchoring system includes a suction cup for attaching via suction to cement.

Referring to FIGS. 2A and 2B, examples are depicted of a perspective view of the anchoring system 118 of the backstop 100. In FIG. 2A, the anchoring device 122 of the anchoring system 118 includes a screw that has a corkscrew shape for screwing into soil. In FIG. 2B, the anchoring device 122 of the anchoring system 118 includes a suction cup for attaching via suction to cement.

The anchoring device may be of several different configurations appropriate to secure the backstop 100 to the bottom 116 of the body of water 108. For example, the body of water 108 may be a natural lake or ocean and the underlying bottom 116 may be composed of soil. In that case, the anchoring device 122 may be a screw that may have a general corkscrew shape, which is operable to be screwed into the soil of the underlying bottom 116. By way of another example, the body of water 108, may be a manmade swimming pool and the underlying bottom 116 may be composed of cement. In that case, the anchoring device 122 may include a suction cup that is operable to attach via suction to the cement of the underlying bottom 116.

Figure 3A:
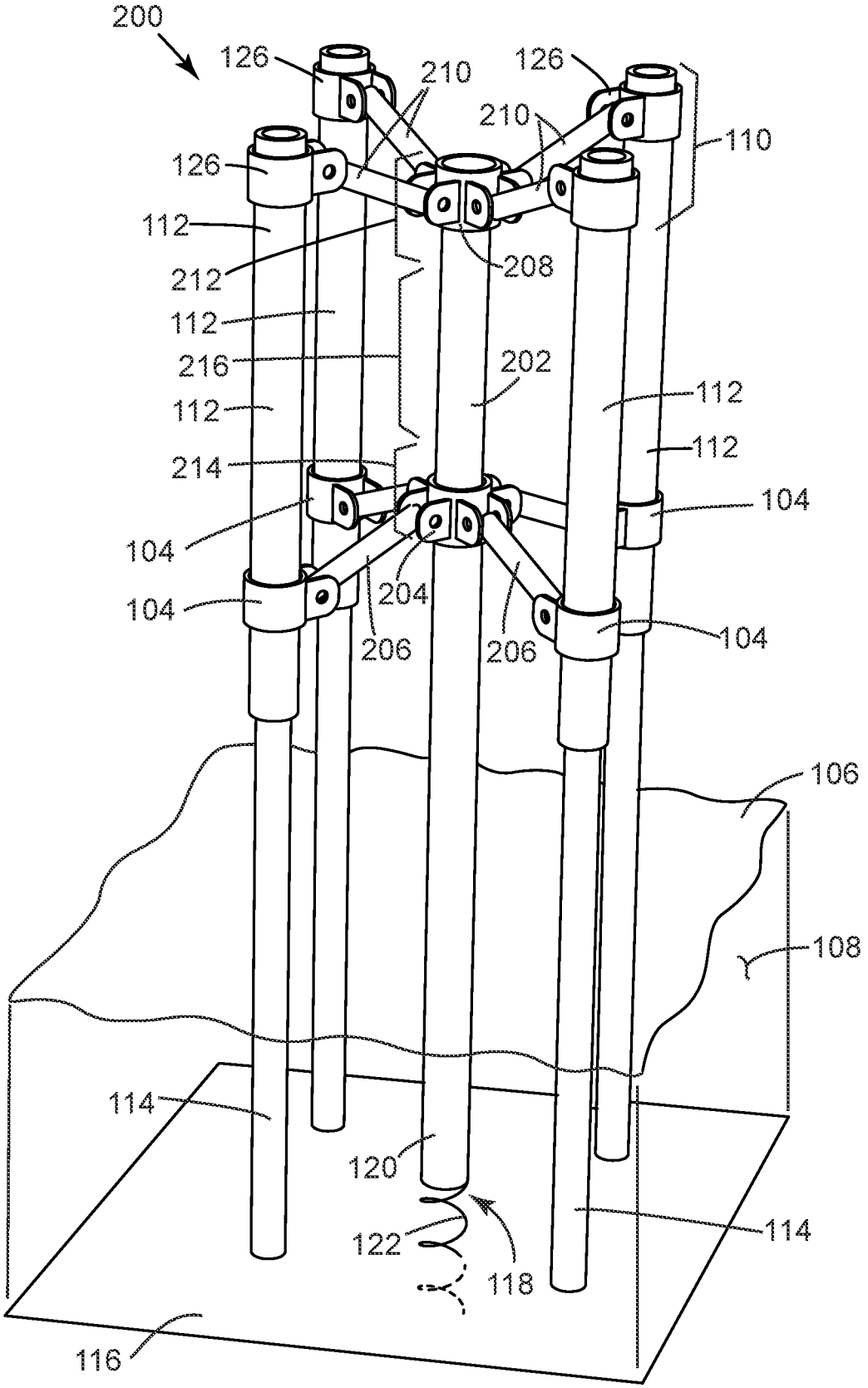
FIG. 3A depicts an example of a perspective view of foldable aquatic backstop in its extended position, according to aspect described herein.

Referring to FIG. 3A, an example is depicted of a perspective view of foldable aquatic backstop 200 in an extended position, according to aspect described herein. The backstop 200 includes a central shaft 202. Which is centrally located between the corner support posts 110.

The lower frame structure 102 of the foldable backstop 200 further includes a lower center junction 204 that is slidably disposed on the central shaft. The lower frame structure 102 also includes a plurality of lower ribs 206. Each lower rib 206 is pivotally attached to both a lower corner junction 104 and the lower center junction 204.

The upper frame structure 110 of the foldable backstop 200 further includes an upper center junction 208 slidably disposed on the central shaft 202. The upper frame structure 110 also includes a plurality of upper ribs 210. Each upper rib 210 is pivotally attached to both an upper corner junction 126 and the upper center junction 208.

Figure 3B:
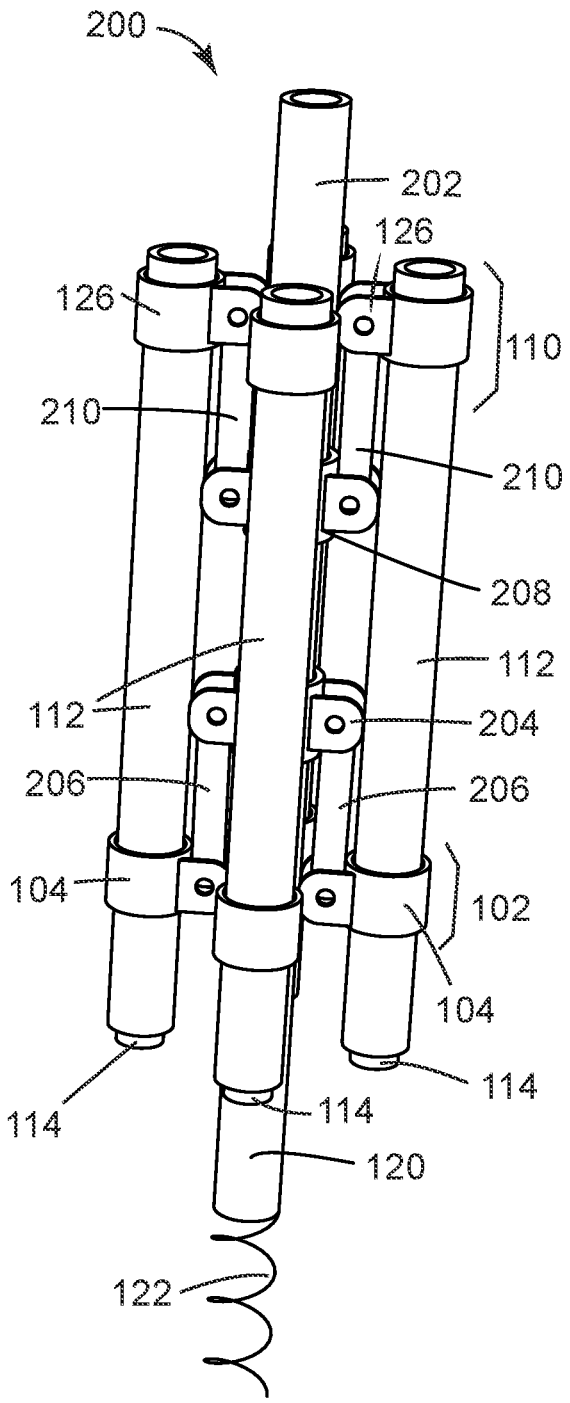
FIG. 3B depicts an example of a perspective view of the foldable aquatic backstop in its folded position, according to aspect described herein.

The aquatic foldable backstop 200 has an extended position and a folded position. FIG. 3A illustrates the backstop 200 in its extended position. FIG. 3B illustrates the backstop in its folded position.

In the extended position (FIG. 3A), the upper center junction 208 is releasably positioned on an upper end portion 212 of the central shaft 202. The lower center junction 204 is releasably positioned on a lower end portion 214 of the central shaft 202.

Also in the extended position, the upper 210 and lower ribs 206 are extended radially and laterally outward from the central shaft 202. For example, the upper 210 and lower ribs 206 may extend substantially perpendicularly (within plus or minus 5 degrees or less) relative to the central shaft 202. Also be way of example, the upper and lower ribs 210, 206 may extend radially and laterally within a range of plus or minus 30 degrees, 20 degrees, 10 degrees or less from being perpendicular relative to the central shaft 202.

In the extended position, the upper center junction 208 and lower center junction 204 may be releasably positioned on the central shaft 202 via a push button release mechanism (not shown). Moreover, the upper and lower center junctions 208, 204 may be releasably positioned and held in their extended positions by several different appropriately designed release mechanisms.

Referring to FIG. 3B, an example is depicted of a perspective view of the foldable aquatic backstop 200 in its folded position, according to aspect described herein. In the folded position, the upper center junction 208 is slidably positioned in a middle portion 216 of the central shaft 202. The middle portion 216 of the central shaft 202 being between the upper end portion 212 and the lower end portion 214 of the central shaft 202. Additionally, in the folded position of the backstop 200, the lower center junction 204 is slidably positioned in the same middle portion 216 of the central shaft 202. The upper 210 and lower 206 ribs are collapsed toward the central shaft 202.

In other words, when moving from its extended position (FIG. 3A) to its folded position (FIG. 3B), the lower center junction 204 is released and slides upward along the central shaft 202 from the lower end portion 214 to the middle portion 216. Additionally, the upper center junction 208 is released and slides downward along the shaft 202 from the upper end portion 212 to the middle portion 216.

Therefore, when the foldable backstop 200 moves from its extended position (FIG. 3A) to its folded position (FIG. 3B), the lower and upper center junctions 204, 208 approach each other in the middle portion 216 of the central shaft 202. Additionally, the upper ribs 210 and lower ribs 206 collapse toward the central shaft to form an acute angle with the central shaft, such as, for example, an of 30 degrees, 20 degrees, 10 degrees, 5 degrees or less. Also, the corner support posts 112 approach the central shaft laterally. Advantageously, the folded backstop 200 enables easy transport and storage of the backstop 200.

Figure 4:
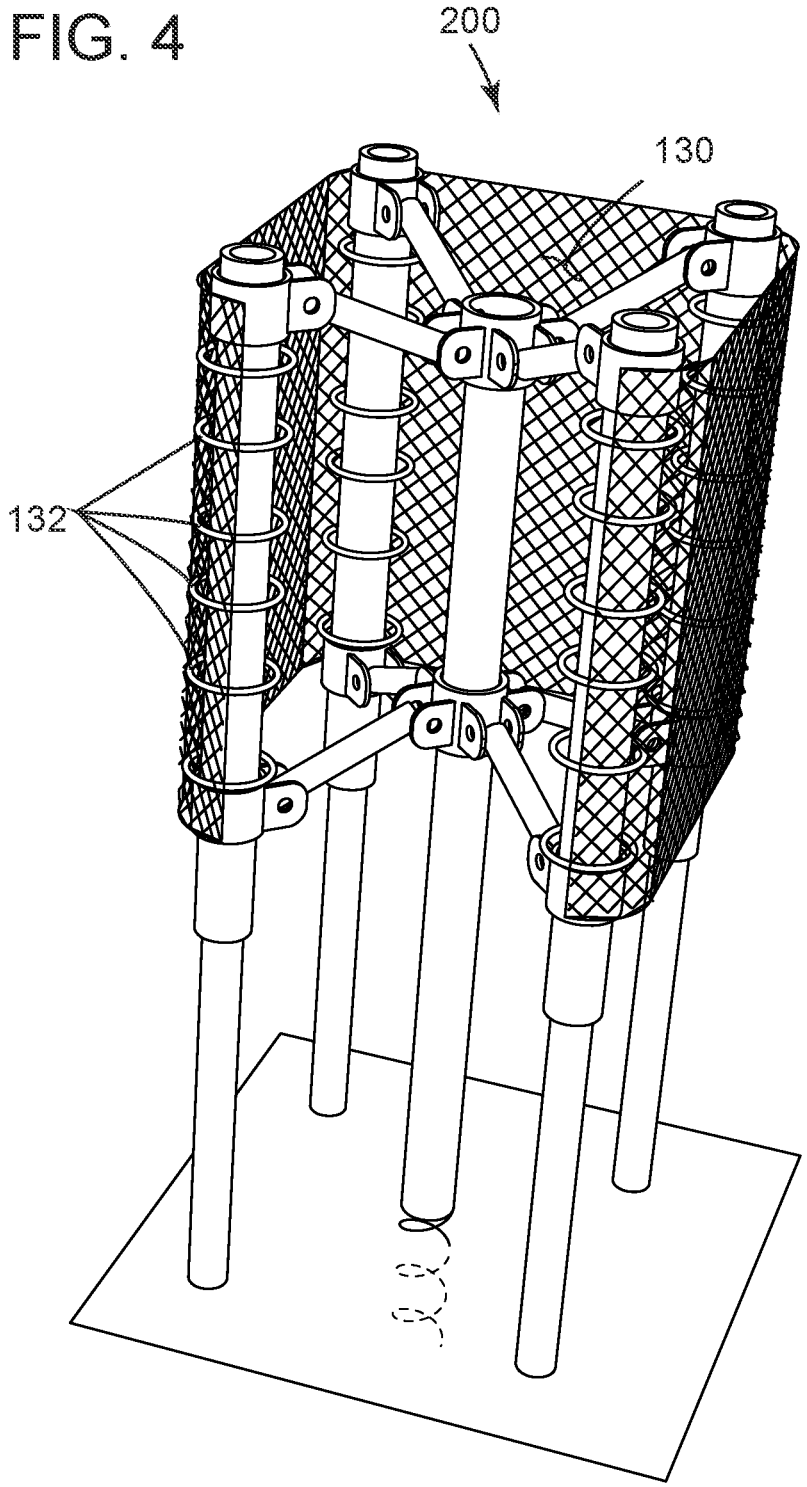
FIG. 4 depicts an example of a perspective view of the foldable aquatic backstop of FIG. 3A with netting disposed thereon, according to aspects described herein.

Referring to FIG. 4, an example is depicted of a perspective view of the foldable aquatic backstop 200 in its extended position with netting disposed thereon, according to aspects described herein.

The foldable backstop 200 may also have a netting 130 disposed on its upper frame structure 110. The netting 130 may be configured to catch a ball skipping over the water. The netting or upper frame may also include various accessories, such as pockets, hoops, score keeping devices or the like for playing different types of games.

The netting 130 may be held in place against the corner support posts 112 via a series of elastic cords 132. However various other appropriately designed attachment devices may be used to secure the netting to the backstop 200.

It should be appreciated that all combinations of the foregoing concepts and additional concepts discussed in greater detail herein (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

Although the invention has been described by reference to specific examples, it should be understood that numerous changes may be made within the spirit and scope of the inventive concepts described. Accordingly, it is intended that the disclosure not be limited to the described examples, but that it have the full scope defined by the language of the following claims.

What is claimed is:

1. An aquatic backstop comprising:

at least three lower corner junctions, the lower corner junctions configured to be leveled with a surface of a body of water;

hollow corner support posts, each corner support post extending upwards above the water from each lower corner junction;

at least three upper corner junctions, each upper corner junction disposed on an upper distal end portion of each corner support post;

a central shaft, centrally located between the corner support posts;

a lower center junction slidably disposed on the central shaft;

lower ribs, each lower rib pivotally attached to both one of the at least three lower corner junction and the lower center junction;

an upper center junction slidably disposed on the central shaft;

upper ribs, each upper rib pivotally attached to both one of the at least three upper corner junction and the upper center junction;

legs slidably disposed within each of the corner support posts, each leg configured to extend downward from each lower corner junction to compensate for a topography of an underlying bottom of the body of water; and an anchoring device attached to the central shaft and configured to secure the aquatic backstop to the underlying bottom.

2. The aquatic backstop of claim 1, comprising the backstop having an extended position and a folded position, wherein:

in the extended position:

the upper center junction is releasably positioned on an upper end portion of the central shaft, the lower center junction is releasably positioned on a lower end portion of the central shaft, and the upper and lower ribs are extended radially and laterally outward from the central shaft; and in the folded position:

the upper center junction is slidably positioned in a middle portion of the central shaft, the middle portion of the central shaft being between the upper end portion and the lower end portion of the central shaft, the lower center junction is slidably positioned in the middle portion of the central shaft, and the upper and lower ribs are collapsed toward the central shaft.

3. The aquatic backstop of claim 2, wherein:

in the extended position, the upper center junction and lower center junction are releasably positioned on the central shaft via a push button release mechanism.

4. The aquatic backstop of claim 1, wherein:

the body of water is a natural lake or ocean and the underlying bottom is comprised of soil; and the anchoring device has a general corkscrew shape that is operable to screw into the soil of the underlying bottom.

5. The aquatic backstop of claim 1, wherein:

the body of water is a manmade swimming pool and the underlying bottom is comprised of cement; and the anchoring device is comprised of a suction cup that is operable to attach via suction to the cement of the underlying bottom.

6. The aquatic backstop of claim 1, wherein the at least three lower corner junctions comprise four lower corner junctions.

7. The aquatic backstop of claim 1, wherein netting is disposable on the upper frame structure, the netting being configured to catch a ball skipping over the water.

* * * * *